US010465717B2

(12) United States Patent
Hoffman et al.

(10) Patent No.: US 10,465,717 B2
(45) Date of Patent: Nov. 5, 2019

(54) SYSTEMS AND METHODS FOR A COMMON MANIFOLD WITH INTEGRATED HYDRAULIC ENERGY TRANSFER SYSTEMS

(71) Applicant: Energy Recovery, Inc., San Leandro, CA (US)

(72) Inventors: Adam Rothschild Hoffman, San Francisco, CA (US); Alexander Patrick Theodossiou, San Francisco, CA (US); David Deloyd Anderson, Castro Valley, CA (US); Farshad Ghasripoor, Berkeley, CA (US); Jeremy Grant Martin, Oakland, CA (US)

(73) Assignee: ENERGY RECOVERY, INC., San Leandro, CA (US)

( * ) Notice: Subject to any disclaimer, the term of this patent is extended or adjusted under 35 U.S.C. 154(b) by 869 days.

(21) Appl. No.: 14/958,383

(22) Filed: Dec. 3, 2015

(65) Prior Publication Data

US 2016/0160889 A1 Jun. 9, 2016

Related U.S. Application Data

(60) Provisional application No. 62/088,435, filed on Dec. 5, 2014.

(51) Int. Cl.

| | |
|---|---|
| ***F04F 13/00*** | (2009.01) |
| ***E21B 43/26*** | (2006.01) |
| ***E21B 43/267*** | (2006.01) |

(52) U.S. Cl.

CPC ..... *F04F 13/00* (2013.01); *E21B 43/26* (2013.01); *E21B 43/267* (2013.01)

(58) Field of Classification Search

CPC ..... F15B 15/063; E21B 43/267; E21B 43/26; F04F 13/00; F04F 1/10; F04F 1/12

See application file for complete search history.

(56) References Cited

U.S. PATENT DOCUMENTS 2,704,034 A * 3/1955 Jones ..... F04F 1/10 417/102
2,897,762 A * 8/1959 Houvener ..... F03C 1/22 251/351

(Continued)

FOREIGN PATENT DOCUMENTS

| | | |
|---|---|---|
| CA | 2508953 A1 | 12/2006 |
| JP | 2013076379 A | 4/2013 |
| RU | 57434 U | 10/2006 |

OTHER PUBLICATIONS

Canadian Office Action; Application No. 2,969,726; dated Mar. 19, 2018; 3 pages.

(Continued)

*Primary Examiner* — Nathan C Zollinger
(74) *Attorney, Agent, or Firm* — Fletcher Yoder, P.C.

(57) ABSTRACT

A system includes a hydraulic fracturing system including a hydraulic energy transfer system configured to exchange pressures between a first fluid and a second fluid. The hydraulic fracturing system also includes a common manifold including one or more high pressure manifolds and one or more low pressure manifolds. The one or more high pressure manifolds and the one or more low pressure manifolds are coupled to the hydraulic energy transfer system.

19 Claims, 7 Drawing Sheets

(56) References Cited

U.S. PATENT DOCUMENTS

| | | | | |
|---|---|---|---|---|
| 3,431,747 | A * | 3/1969 | Hashemi | B01D 61/06 417/339 |
| 3,602,612 | A * | 8/1971 | Osdor | F15B 11/17 417/102 |
| 4,887,942 | A * | 12/1989 | Hauge | F04F 13/00 417/64 |
| 5,899,272 | A * | 5/1999 | Loree | C09K 8/80 166/280.2 |
| 6,540,487 | B2 * | 4/2003 | Polizos | F04B 1/2042 210/652 |
| 7,080,656 | B2 | 7/2006 | McCarthy | |
| 7,214,315 | B2 * | 5/2007 | Shumway | B01D 61/06 210/137 |
| 7,303,597 | B2 | 12/2007 | Sprouse et al. | |
| 9,700,843 | B2 | 7/2017 | Giraud | |
| 9,759,054 | B2 * | 9/2017 | Gay | E21B 43/267 |
| 9,945,216 | B2 * | 4/2018 | Ghasripoor | E21B 43/16 |
| 2006/0037895 | A1 * | 2/2006 | Shumway | B01D 61/06 210/137 |
| 2006/0037907 | A1 * | 2/2006 | Shumway | B01D 61/06 210/416.1 |
| 2007/0277982 | A1 | 12/2007 | Shampine et al. | |
| 2012/0217011 | A1 | 8/2012 | Dotson et al. | |
| 2013/0284455 | A1 * | 10/2013 | Kajaria | E21B 43/26 166/379 |
| 2014/0128655 | A1 * | 5/2014 | Arluck | C07C 7/11 585/860 |
| 2014/0128656 | A1 | 5/2014 | Arluck et al. | |
| 2014/0277772 | A1 * | 9/2014 | Lopez | F04D 13/12 700/282 |

OTHER PUBLICATIONS

PCT International Search Report and Written Opinion; Application No. PCT/US2015/063870; dated Mar. 18, 2016; 12 pages.

JP Application 2017529692; 1st Office Action dated Jun. 29, 2018; pp. 1-13.

CN Application 201580075604.5; 1st Office Action dated Sep. 29, 2018; pp. 1-10.

RU Application No. 2017123738/03(041190); Notice of Allowance Aug. 15, 2018; 18 pages.

* cited by examiner 30
40
42
44
46
48
50
52
54
56
58
60
62
64
66
68
70
72
74
76
78
80
81
83
85
87

SYSTEMS AND METHODS FOR A COMMON MANIFOLD WITH INTEGRATED HYDRAULIC ENERGY TRANSFER SYSTEMS

CROSS-REFERENCE TO RELATED APPLICATION

This application claims priority to and the benefit of U.S. Provisional Application No. 62/088,435, entitled "SYSTEMS AND METHODS FOR A COMMON MANIFOLD WITH INTEGRATED HYDRAULIC ENERGY TRANSFER SYSTEMS," filed Dec. 5, 2014, the disclosure of which is hereby incorporated by reference in its entirety for all purposes.

BACKGROUND

This section is intended to introduce the reader to various aspects of art that may be related to various aspects of the present invention, which are described and/or claimed below. This discussion is believed to be helpful in providing the reader with background information to facilitate a better understanding of the various aspects of the present invention. Accordingly, it should be understood that these statements are to be read in this light, and not as admissions of prior art.

The subject matter disclosed herein relates to hydraulic fracturing systems, and, more particularly, to hydraulic fracturing systems including a manifold missile with hydraulic energy transfer systems.

Well completion operations in the oil and gas industry often involve hydraulic fracturing (often referred to as fracking or fracing) to increase the release of oil and gas in rock formations. Hydraulic fracturing involves pumping a fluid (e.g., frac fluid) containing a combination of water, chemicals, and proppant (e.g., sand, ceramics) into a well at high-pressures. The high-pressures of the fluid increases crack size and propagation through the rock formation releasing more oil and gas, while the proppant prevents the cracks from closing once the fluid is depressurized.

A variety of equipment is used in the fracturing process. For example, a fracturing operation may utilize a common manifold (often referred to as a missile, missile trailer, or a manifold trailer) coupled to multiple high pressure pumps. The common manifold may receive low pressure frac fluid from a fracing fluid blender and may route the low pressure frac fluid to the high pressure pumps, which may increase the pressure of the frac fluid. Unfortunately, the proppant in the frac fluid may increase wear and maintenance on the high pressure pumps.

BRIEF DESCRIPTION OF THE DRAWINGS

Various features, aspects, and advantages of the present invention will become better understood when the following detailed description is read with reference to the accompanying figures in which like characters represent like parts throughout the figures, wherein.

DETAILED DESCRIPTION OF SPECIFIC EMBODIMENTS

Figure 1:
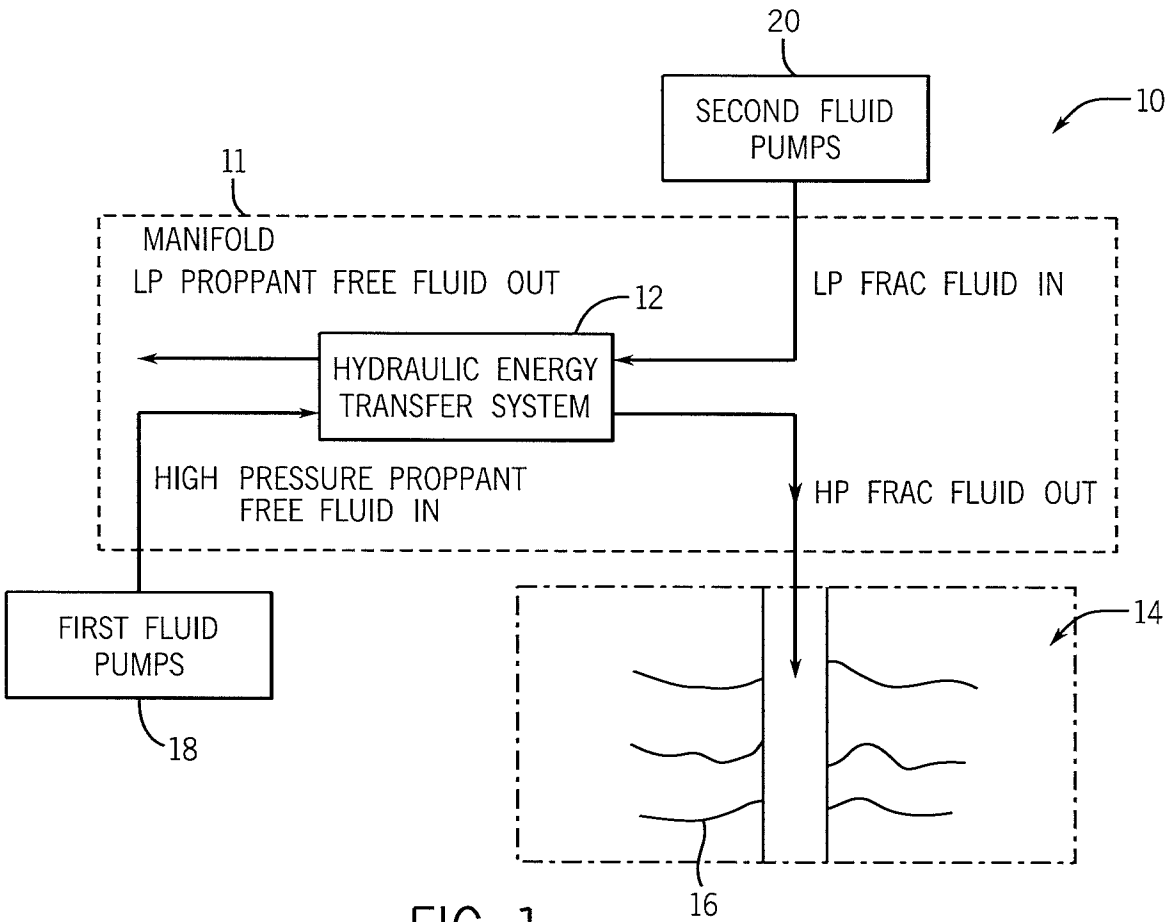
FIG. 1 is a schematic diagram of a hydraulic fracturing system with a common manifold including one or more hydraulic energy transfer systems.

One or more specific embodiments of the present invention will be described below. These described embodiments are only exemplary of the present invention. Additionally, in an effort to provide a concise description of these exemplary embodiments, all features of an actual implementation may not be described in the specification. It should be appreciated that in the development of any such actual implementation, as in any engineering or design project, numerous implementation-specific decisions must be made to achieve the developers' specific goals, such as compliance with system-related and business-related constraints, which may vary from one implementation to another. Moreover, it should be appreciated that such a development effort might be complex and time consuming, but would nevertheless be a routine undertaking of design, fabrication, and manufacture for those of ordinary skill having the benefit of this disclosure.

As noted above, hydraulic fracturing systems generally include a common manifold (often referred to as a missile, missile trailer, or a manifold trailer) coupled to multiple high pressure pumps that pressurize a frac fluid. In particular, the common manifold may receive low pressure frac fluid from a fracing fluid blender and may route the low pressure frac fluid to the high pressure pumps, which may increase the pressure of the frac fluid. Unfortunately, the proppant in the frac fluid may increase wear and maintenance on the high pressure pumps.

As discussed in detail below, the embodiments disclosed herein generally relate to a hydraulic fracturing system including a common manifold that integrates one or more hydraulic energy transfer systems into the hydraulic fracturing system. The hydraulic energy transfer system transfers work and/or pressure between a first fluid (e.g., a pressure exchange fluid, such as a proppant free or a substantially proppant free fluid) and a second fluid (e.g., a proppant containing fluid, such as a frac fluid). In this manner, the hydraulic fracturing system may pump a proppant containing fluid into a well at high pressure, while blocking or limiting wear on high pressure pumps. Additionally, as will be described in more detail below, the common manifold may integrate the one or more hydraulic energy transfer systems within the low pressure piping and the high pressure piping of the common manifold. As such, the one or more hydraulic energy transfer systems may not be directly coupled to any low pressure or high pressure pumps. As will be described in more detail below, this may be desirable because it enables the common manifold to distribute flow among the one or more hydraulic energy transfer systems despite pipe size and weight constraints. Additionally, this may enable the common manifold to minimize pressure losses, balance flow rates, and compensate for leakage flow among the one or more hydraulic energy transfer systems, as well as to adjust for variable volumes of proppant and chemicals added to the fluid (e.g., a clean fluid, a non-corrosive fluid, water, etc.). Further, this may enable the common manifold to bring individual hydraulic energy transfer systems on or offline without interrupting the fracturing process, and/or to switch the hydraulic fracturing system to traditional operation (e.g., without utilizing hydraulic energy transfer systems).

With the foregoing in mind, FIG. 1 is a schematic diagram of an embodiment of a hydraulic fracturing system 10 with a common manifold 11 (e.g., a manifold, a missile, a missile trailer, a manifold trailer) that incorporates one or more hydraulic energy transfer systems 12 (e.g., fluid handling system, hydraulic protection system, hydraulic buffer system, or hydraulic isolation system) into the hydraulic fracturing system 10. As will be described in more detail below, the common manifold 11 includes a plurality of pipes, valves, sensors, and control instrumentation, and the common manifold 11 is configured to connect the low pressure and the high pressure piping of the hydraulic fracturing system 10 to the one or more hydraulic energy transfer systems 12. Further, the common manifold 11 is configured to minimize pressure losses, balance flow rates, and compensate for leakage flow of the one or more hydraulic energy transfer systems 12, as well as to adjust for variable volumes of proppant and chemicals.

The hydraulic fracturing system 10 enables well completion operations to increase the release of oil and gas in rock formations. Specifically, the hydraulic fracturing system 10 pumps a proppant containing fluid (e.g., a frac fluid) containing a combination of water, chemicals, and proppant (e.g., sand, ceramics, etc.) into a well 14 at high pressures. The high pressures of the proppant containing fluid increases the size and propagation of cracks 16 through the rock formation, which releases more oil and gas, while the proppant keeps the cracks 16 from closing once the proppant containing fluid is depressurized. As illustrated, the hydraulic fracturing system 10 may include one or more first fluid pumps 18 and one or more second fluid pumps 20 coupled to common manifold 11 and to one or more the hydraulic energy transfer systems 12. For example, the one or more hydraulic energy transfer systems 12 may include a hydraulic turbocharger, rotary isobaric pressure exchanger (IPX), reciprocating IPX, or any combination thereof.

In operation, the hydraulic energy transfer system 12 transfers pressures without any substantial mixing between a first fluid (e.g., proppant free fluid) pumped by the first fluid pumps 18 and a second fluid (e.g., proppant containing fluid or frac fluid) pumped by the second fluid pumps 20. In this manner, the hydraulic energy transfer system 12 blocks or limits wear on the first fluid pumps 18 (e.g., high-pressure pumps), while enabling the hydraulic fracturing system 10 to pump a high-pressure frac fluid into the well 14 to release oil and gas.

As noted above, the one or more hydraulic energy transfer systems 12 may be pressure exchangers (e.g., rotary isobaric pressure exchangers (IPX)). However, it should be appreciated that in other embodiments, the one or more hydraulic energy transfer systems may be hydraulic turbochargers, reciprocating IPXs, or any combination thereof. As used herein, the isobaric pressure exchanger (IPX) may be generally defined as a device that transfers fluid pressure between a high pressure inlet stream and a low pressure inlet stream at efficiencies in excess of approximately 50%, 60%, 70%, 80%, 90%, or more without utilizing centrifugal technology. In this context, high pressure refers to pressures greater than the low pressure. The low pressure inlet stream of the IPX may be pressurized and exit the IPX at high pressure (e.g., at a pressure greater than that of the low pressure inlet stream), and the high pressure inlet stream may be depressurized and exit the IPX at low pressure (e.g., at a pressure less than that of the high pressure inlet stream). Additionally, the IPX may operate with the high pressure fluid directly applying a force to pressurize the low pressure fluid, with or without a fluid separator between the fluids. Examples of fluid separators that may be used with the IPX include, but are not limited to, pistons, bladders, diaphragms and the like. In certain embodiments, isobaric pressure exchangers may be rotary devices. Rotary isobaric pressure exchangers (IPXs), such as those manufactured by Energy Recovery, Inc. of San Leandro, Calif., may not have any separate valves, since the effective valving action is accomplished internal to the device via the relative motion of a rotor with respect to end covers, as described in detail below with respect to FIGS. 2-6. Rotary IPXs may be designed to operate with internal pistons to isolate fluids and transfer pressure with relatively little mixing of the inlet fluid streams. Reciprocating IPXs may include a piston moving back and forth in a cylinder for transferring pressure between the fluid streams. Any IPX or plurality of IPXs may be used in the disclosed embodiments, such as, but not limited to, rotary IPXs, reciprocating IPXs, or any combination thereof.

Figure 2:
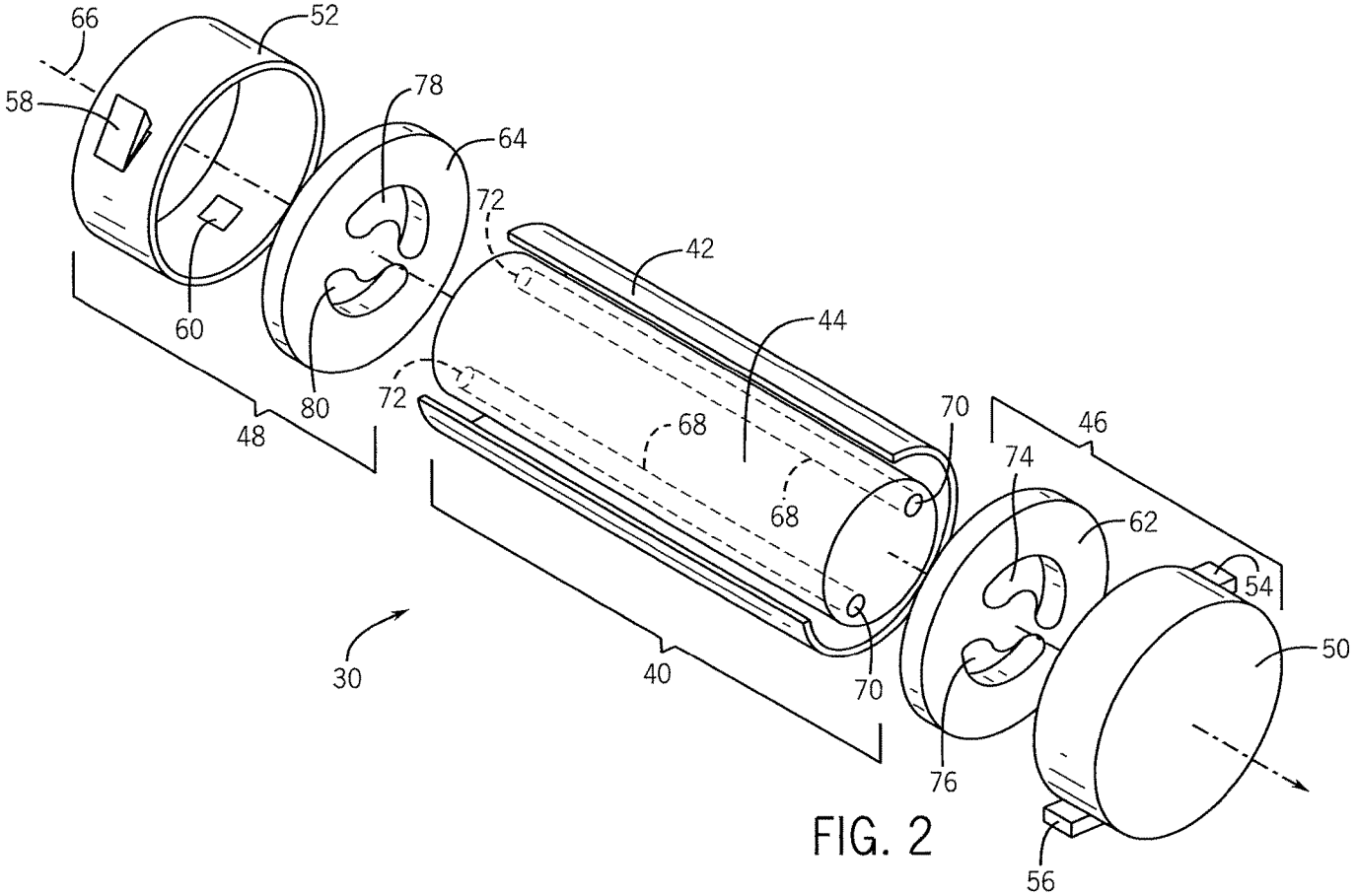
FIG. 2 is an exploded perspective view of an embodiment of the hydraulic energy transfer system of FIG. 1, illustrated as a rotary isobaric pressure exchanger (IPX) system.

FIG. 2 is an exploded view of an embodiment of a rotary IPX 30. In the illustrated embodiment, the rotary IPX 30 may include a generally cylindrical body portion 40 that includes a sleeve 42 and a rotor 44. The rotary IPX 30 may also include two end structures 46 and 48 that include manifolds 50 and 52, respectively. Manifold 50 includes inlet and outlet ports 54 and 56, and manifold 52 includes inlet and outlet ports 60 and 58. For example, inlet port 54 may receive a first fluid (e.g., proppant-free fluid) at a high pressure and the outlet port 56 may be used to route the first fluid a low pressure away from the rotary IPX 30. Similarly, inlet port 60 may receive a second fluid (e.g., proppant-containing fluid or frac fluid) and the outlet port 58 may be used to route the second fluid at high pressure away from the rotary IPX 30. The end structures 46 and 48 include generally flat endplates 62 and 64 (e.g., endcovers), respectively, disposed within the manifolds 50 and 52, respectively, and adapted for fluid sealing contact with the rotor 44.

The rotor 44 may be cylindrical and disposed in the sleeve 42, and is arranged for rotation about a longitudinal axis 66 of the rotor 44. The rotor 44 may have a plurality of channels 68 extending substantially longitudinally through the rotor 44 with openings 70 and 72 at each end arranged symmetrically about the longitudinal axis 66. The openings 70 and 72 of the rotor 44 are arranged for hydraulic communication with the endplates 62 and 64, and inlet and outlet apertures 74 and 76, and 78 and 80, in such a manner that during rotation they alternately hydraulically expose fluid at high pressure and fluid at low pressure to the respective manifolds 50 and 52. The inlet and outlet ports 54, 56, 58, and 60, of the manifolds 50 and 52 form at least one pair of ports for high pressure fluid in one end element 46 or 48, and at least one pair of ports for low pressure fluid in the opposite end element, 48 or 46. The endplates 62 and 64, and inlet and outlet apertures 74 and 76, and 78 and 80 are designed with perpendicular flow cross sections in the form of arcs or segments of a circle.

FIGS. 3-6 are exploded views of an embodiment of the rotary IPX 30 illustrating the sequence of positions of a single channel 68 in the rotor 44 as the channel 68 rotates through a complete cycle. It is noted that FIGS. 3-6 are simplifications of the rotary IPX 30 showing one channel 68, and the channel 68 is shown as having a circular cross-sectional shape. In other embodiments, the rotary IPX 30 may include a plurality of channels 68 (e.g., 2 to 100) with different cross-sectional shapes (e.g., circular, oval, square, rectangular, polygonal, etc.). Thus, FIGS. 3-6 are simplifications for purposes of illustration, and other embodiments of the rotary IPX 30 may have configurations different from that shown in FIGS. 3-6. As described in detail below, the rotary IPX 30 facilitates a hydraulic exchange of pressure between first and second fluids (e.g., proppant free fluid and proppant-laden fluid) by enabling the first and second fluids to momentarily contact each other within the rotor 44. In certain embodiments, this exchange happens at speeds that results in little mixing of the first and second fluids.

Figures 3, 4, 5, 6:
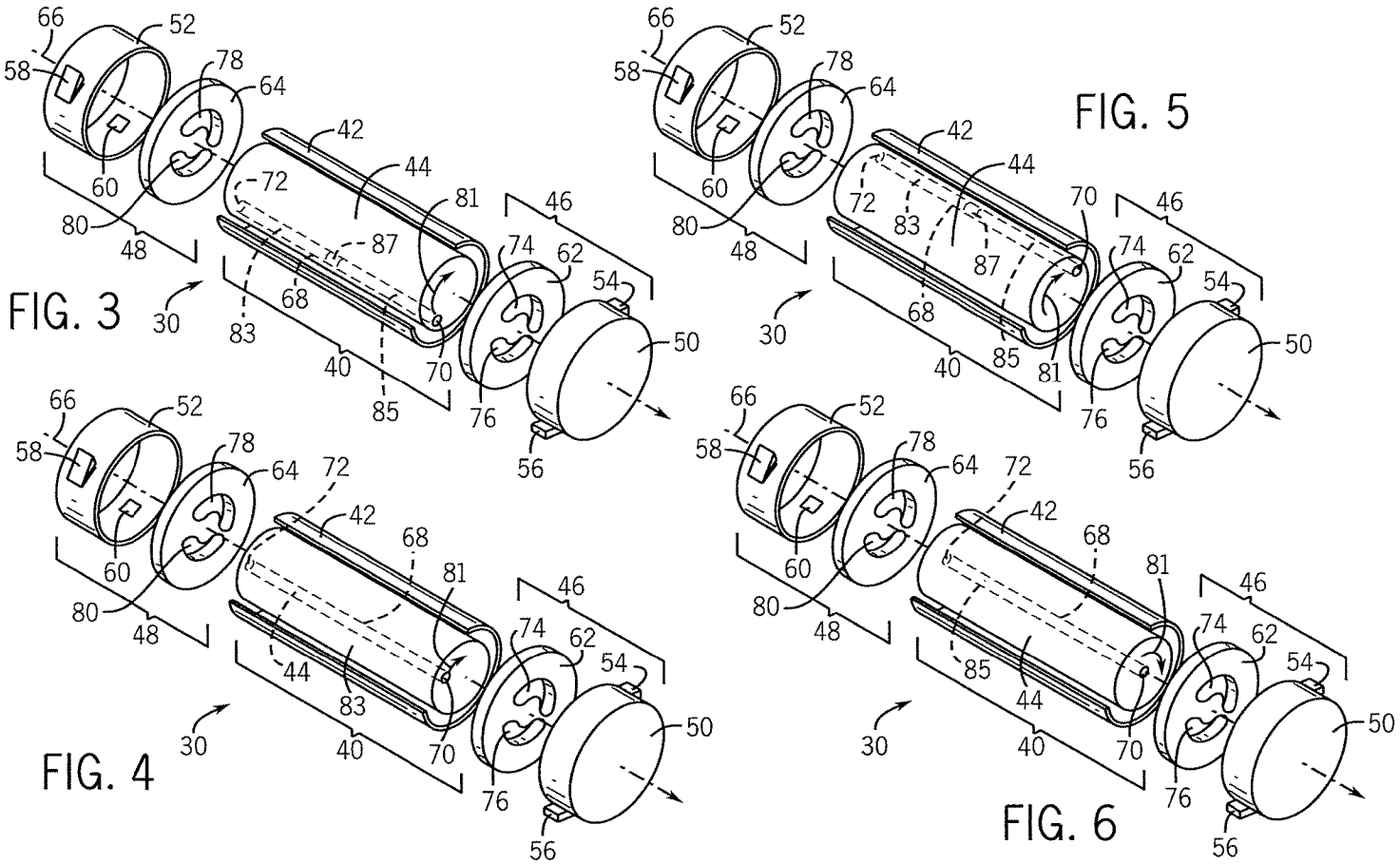
FIG. 3 is an exploded perspective view of an embodiment of a rotary IPX in a first operating position.
FIG. 4 is an exploded perspective view of an embodiment of a rotary IPX in a second operating position.
FIG. 5 is an exploded perspective view of an embodiment of a rotary IPX in a third operating position.
FIG. 6 is an exploded perspective view of an embodiment of a rotary IPX in a fourth operating position.

In FIG. 3, the channel opening 70 is in a first position. In the first position, the channel opening 70 is in hydraulic communication with the aperture 76 in endplate 62 and therefore with the manifold 50, while opposing channel opening 72 is in hydraulic communication with the aperture 80 in endplate 64 and by extension with the manifold 52. As will be discussed below, the rotor 44 may rotate in the clockwise direction indicated by arrow 90. In operation, low pressure second fluid 92 passes through endplate 64 and enters the channel 68, where it contacts first fluid 94 at a dynamic interface 96. The second fluid 92 then drives the first fluid 94 out of the channel 68, through the endplate 62, and out of the rotary IPX 30. However, because of the short duration of contact, there is minimal mixing between the first fluid 94 and the second fluid 92.

In FIG. 4, the channel 68 has rotated clockwise through an arc of approximately 90 degrees. In this position, the opening 72 is no longer in hydraulic communication with the apertures 78 and 80 of the endplate 64, and the opening 70 of the channel 68 is no longer in hydraulic communication with the apertures 74 and 76 of the endplate 62. Accordingly, the low pressure second fluid 92 is temporarily contained within the channel 68.

In FIG. 5, the channel 68 has rotated through approximately 180 degrees of arc from the position shown in FIG. 3. The opening 72 is now in hydraulic communication with the aperture 78 in the endplate 64, and the opening 70 of the channel 68 is now in hydraulic communication with the aperture 74 of the endplate 62. In this position, high pressure first fluid 94 enters and pressures the low pressure second fluid 94, driving the second fluid 94 out of the channel 68 and through the aperture 74 for use in the hydraulic fracturing system 10.

In FIG. 6, the channel 68 has rotated through approximately 270 degrees of arc from the position shown in FIG. 3. In this position, the opening 72 is no longer in hydraulic communication with the apertures 78 and 80 of the endplate 64, and the opening 70 is not longer in hydraulic communication with the apertures 74 and 76 of the endplate 62. Accordingly, the high pressure first fluid 94 is no longer pressurized and is temporarily contained within the channel 68 until the rotor 44 rotates another 90 degrees, starting the cycle over again.

Figure 7:
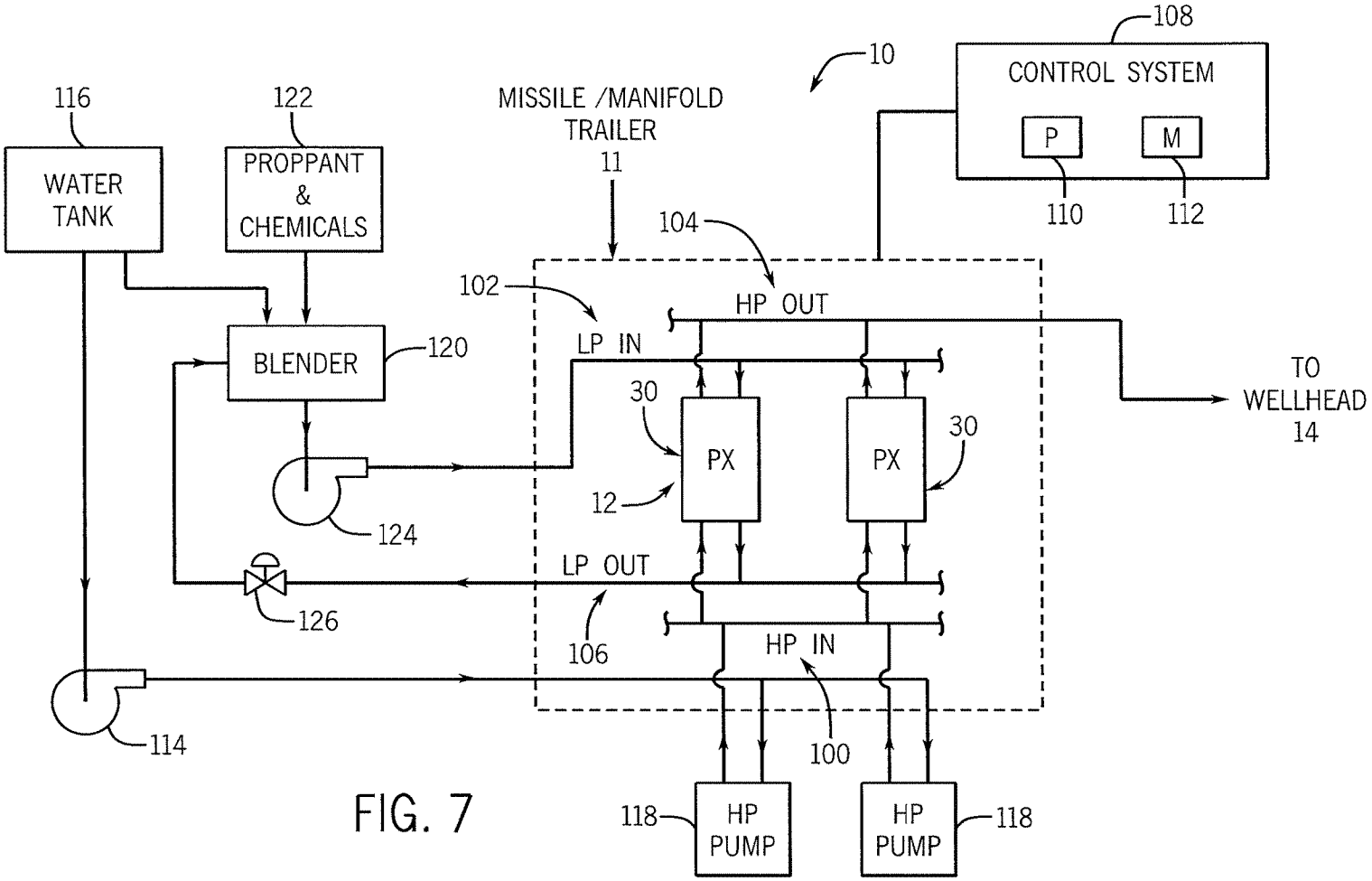
FIG. 7 is a schematic diagram of the hydraulic fracturing system of FIG. 1 including the common manifold and one or more of the rotary IPXs of FIG. 2 integrated within the common manifold.

FIG. 7 is a schematic diagram of an embodiment of the hydraulic fracturing system 10, the common manifold 11 (e.g., a central manifold, a missile, a missile trailer, or a manifold trailer), and the one or more hydraulic energy transfer systems 12. In the illustrated embodiment, the one or more hydraulic energy transfer systems 12 may be the rotary IPX 30. While the illustrated embodiment depicts two rotary IPXs 30, it should be noted that the hydraulic fracturing system 10 may include any suitable number of rotary IPXs 30 (e.g., any number between 1 and 20 or more). Further, it should be noted that the one or more rotary IPXs 30 may be connected to the common manifold 11 individually or may be grouped to reduce the amount of piping and valve components required. As noted above, the common manifold 11 connects the low pressure piping and the high pressure piping and integrates the one or more rotary IPXs 30 into the common manifold 11. In particular, the common manifold 11 integrates the one or more rotary IPXs 30 within a high pressure fluid inlet manifold 100 (hereinafter referred to as HP in manifold), a low pressure fluid inlet manifold 102 (hereinafter referred to as LP in manifold), a high pressure fluid outlet manifold 104 (hereinafter referred to as HP out manifold), and a low pressure fluid outlet manifold 106 (hereinafter referred to as LP out manifold). As such, the rotary IPXs 30 may not be directly coupled to any low pressure or high pressure pumps. This may be desirable because it enables the common manifold 11 to distribute flow among the one or more rotary IPXs 30 despite pipe size and weight constraints, which may minimize pressure losses, balance flow rates, and compensate for leakage flow among the rotary IPXs 30, as well as adjusting for variable volumes of proppant and chemicals. Additionally, this may enable the common manifold 11 to bring individual IPXs 30 (as well as high pressure pumps) on or offline without interrupting the fracturing process, or to switch the hydraulic fracturing system 10 to traditional operation (e.g., without utilizing the IPXs 30). Further, the common manifold 11 enables a variable number of high pressure pumps to be used with the hydraulic fracturing system 10, including different types of high pressure pumping technologies.

The HP in manifold 100, LP in manifold 102, HP out manifold 104, and the LP out manifold 106 may include a plurality of pipes (e.g., high pressure piping and/or low pressure piping), a plurality of valves (e.g., flow control valves, high pressure actuated valves, etc.), a plurality of sensors (e.g., flow meters, pressure sensors, speed sensors, pressure exchanger rotor speed sensors), and other instrumentation and control systems. For example, the plurality of valves may be disposed in and/or integrated with the pipes. In some embodiments, the common manifold 11 may be operatively coupled to a control system 108 that includes one or more processors 110 and one or more memory units 112 (e.g., tangible, non-transitory memory units) for controlling the operation of the hydraulic fracturing system 10 and implementing the techniques described herein. For example, each rotary IPX 30 may include between any suitable number of valves (e.g., 1, 2, 3, 4, or more) at the inlets and outlets of the rotary IPX 30, and the processor 110 may be configured to control the valves to independently control the operation of individual rotary IPXs 30 (e.g., to bring individual rotary IPXs 30 on or offline). For example, the processor 110 may control the valves to independently control the flow of the high pressure first fluid and/or the flow of the low pressure second fluid to individual rotary IPXs 30. In some embodiments, the valves may be configured for high pressure flows. Additionally, in some embodiments, the common manifold 11 may include one or more bypass valves, which may be actuated by processor 110, to switch to traditional operation without using the rotary IPXs 30. Further, in some embodiments, the piping (e.g., high pressure piping or low pressure piping) coupled to the rotary IPXs 30 may include flow restrictions (e.g., orifice plates) or adjustable valves, which may be controlled by the processor 110, to balance flow rates among the rotary IPXs 30. In particular, the processor 110 may execute instructions stored on the memory 112 to control the valves of the hydraulic fracturing system 10. Additionally, the piping of the high pressure manifolds 100 and 104 may include larger diameters than typical high pressure iron pipes (e.g., with 3 inch or four inch diameters) to reduce weight and minimize friction losses that may impact the rotary IPX 30 operation. Further, the piping of the high pressure manifolds 100 and 104 may be made of materials other than materials used for typical high pressure manifolds, such as iron and steel. For example, the piping of the high pressure manifolds 100 and 104 may be made of carbon fiber composites or other high-strength, low-weight materials.

As illustrated, the hydraulic fracturing system 10 includes an auxiliary charge pump 114 (e.g., a clean water charge pump) configured to receive a proppant free fluid (e.g., a clean fluid, water, etc.) from a proppant free fluid tank 116 (e.g., a water tank) and to route the proppant free fluid to the common manifold 11. Piping of the common manifold 11 routes the proppant free fluid to one or more high pressure pumps 118 (e.g., pump trucks). While two high pressure pumps 118 are illustrated, it should be appreciated that the hydraulic fracturing system 10 may include any suitable number of high pressure pumps 118 (e.g., any number between 1 and 12 or more). The high pressure pumps 118 may increase the pressure of the proppant free fluid to a high pressure (e.g., between approximately 5,000 kPa to 25,000 kPa, 20,000 kPa to 50,000 kPa, 40,000 kPa to 75,000 kPa, 75,000 kPa to 100,000 kPa or greater). The one or more high pressure pumps 118 may then route the high pressure proppant free fluid to HP in manifold 100, which may route the high pressure proppant fluid to the one or more rotary IPXs 30.

The hydraulic fracturing system 10 may also include a blender 120 configured to receive the proppant free fluid from the proppant free fluid tank 116 and a mixture of proppant and chemicals 12 and to blend the proppant free fluid, the proppant, and the chemicals to produce a proppant containing fluid (e.g., a frac fluid, slurry). A low pressure pump 124 (e.g., a slurry pump) may receive the proppant containing fluid from the blender 120 and may route proppant containing fluid to the common manifold 11. Specifically, the low pressure pump 124 may route the low pressure proppant containing fluid to the LP in manifold 102, which routes the low pressure proppant containing fluid to the one or more rotary IPXs 30. As noted above, the one or more rotary IPXs 30 transfer pressure from the high pressure proppant free fluid to the low pressure proppant containing fluid without any substantial mixing between the high pressure proppant free fluid and the low pressure proppant containing fluid. In particular, the rotary IPXs 30 receive the proppant free fluid at high pressure from the HP in manifold 100 and the proppant containing fluid at low pressure from the LP in manifold 102. The rotary IPXs 30 transfer the pressure from the proppant free fluid to the proppant containing fluid and then discharge the proppant free fluid at low pressure to the LP out manifold 106 and the proppant containing fluid at high pressure to the HP out manifold 104. In this manner, the rotary IPXs 30 block or limit wear on the high pressure pumps 118, while enabling the hydraulic fracturing system 10 to pump a high pressure proppant containing fluid into the well 14 to release oil and gas. Additionally, the hydraulic fracturing system 10 may include one or more auxiliary flow control valves 126 configured to receive the low pressure proppant free fluid from the LP out manifold 106 and to route the low pressure proppant free fluid to the blender 120.

As noted above, by integrating the one or more rotary IPXs 30 within the common manifold 11, the common manifold 11 may be configured to compensate or adjust for leakage flow within the rotary IPXs 30, as well adjust for variable volumes of proppant and chemicals added at the blender. For example, a small amount of flow may leak from the high pressure side to the low pressure side within the rotary IPX 30, which may reduce the volume of the high pressure proppant containing fluid output from the rotary IPX 30. Additionally, the volume of proppant and chemicals added to the blender 120 may vary, and, as such, the proppant containing fluid may include a volume of proppant and chemicals that exceeds a threshold or is undesirable. Accordingly, it may be desirable to provide additional fluid (e.g., proppant free fluid, water, etc.) for the high pressure proppant containing fluid to compensate or adjust for any leakage flow and/or to adjust for variable volumes of proppant and chemicals in the proppant containing fluid. In particular, due to the volume flow of proppant and chemicals added to the blender 120, the slurry flow exiting the blender 120 (e.g., the low pressure inlet flow) will generally be greater than the volume flow entering the blender 120 (e.g., from the low pressure out flow). This is the case even if "blender level makeup flow" is zero and even if the leakage from the rotary IPXs 30 is zero. This volume addition to the low pressure inlet flow is one reason that a small (or large) amount of flow may be diverted from the low pressure outlet flow to either one or more supplemental pumps (see FIG. 8) or to the clean water inlet flow (see FIG. 9).

Figure 8:
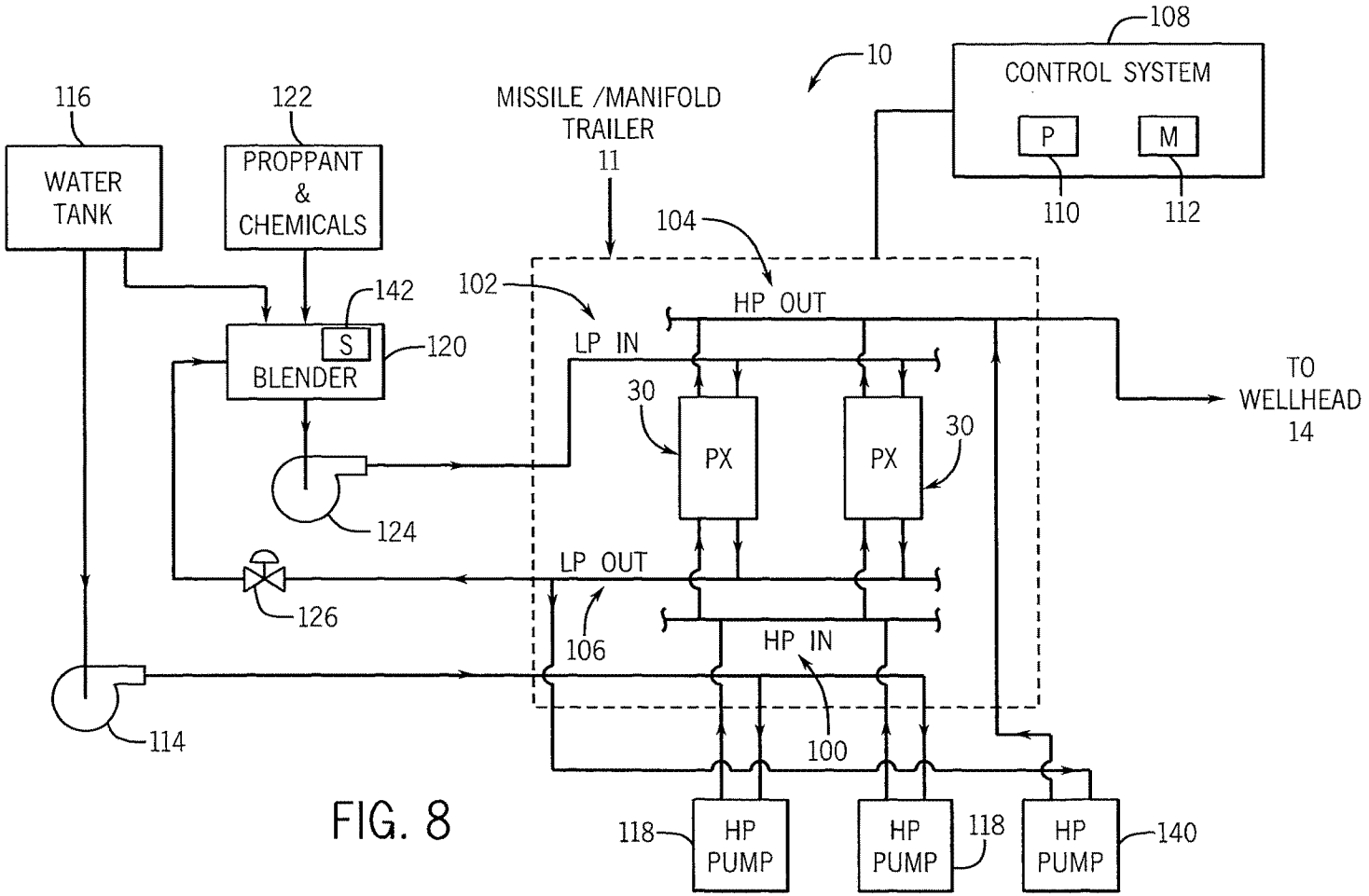
FIG. 8 is a schematic diagram of the hydraulic fracturing system of FIG. 7 including one or more supplemental high pressure pumps.

FIG. 8 illustrates an embodiment of the hydraulic fracturing system 10 including one or more supplemental high pressure pumps 140. The hydraulic fracturing system 10 may include any suitable number of supplemental high pressure pumps 140 (e.g., 1, 2, 3, or more). The one or more supplemental high pressure pumps 140 may receive low pressure proppant free fluid from the LP out manifold 106, which may include a small amount of leakage flow from the high pressure side of the rotary IPXs 30. As illustrated, the one or more supplemental high pressure pumps 140 are not coupled to the HP in manifold 100, but instead are coupled the HP out manifold 104. As such, the one or more supplemental high pressure pumps 140 may provide additional high pressure fluid (e.g., high pressure proppant free fluid) to the high pressure proppant containing fluid, which may compensate for any leakage flow and/or adjust for variable volumes of proppant and chemicals in the proppant containing fluid. In some embodiments, the blender 120 may include one or more sensors 142 (e.g., flow meters) to monitor the flow and/or volume of the proppant and chemicals 122 into the blender 120. The processor 110 of the control system 108 may be configured to receive signals from the one or more sensors 142 and to control the operation of the common manifold 11 based on the received signals. For example, the processor 110 may determine whether a volume of proppant and chemicals exceeds a predetermined threshold and may bring the one or more supplemental high pressure pumps 140 online and/or control one or more actuated valves of the common manifold 11 to direct the low pressure proppant free fluid from the LP out manifold 106 to the one or more supplemental high pressure pumps 142 in response to a determination that the volume of proppant and chemicals exceeds the predetermined threshold. In particular, the low pressure proppant free fluid from the LP out manifold 106 may be directed to the one or more supplemental high pressure pumps 142 to make up for volumes of proppant and chemicals added to the blender 120.

Figure 9:
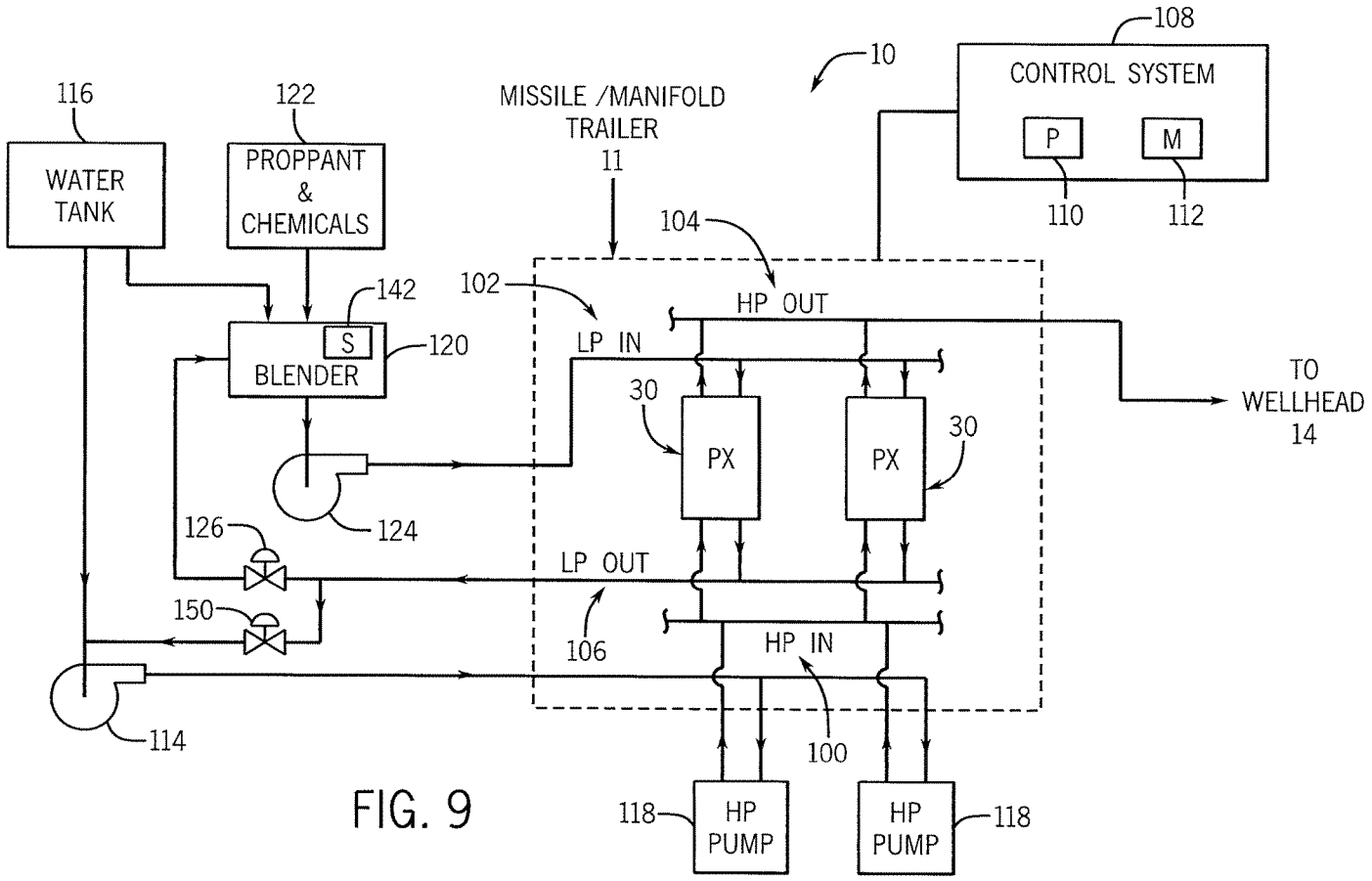
FIG. 9 is a schematic diagram of the hydraulic fracturing system of FIG. 7 including a supplemental flow control valve external to the common manifold.

FIG. 9 illustrates an embodiment of the hydraulic fracturing system 10 including a flow split of the low pressure proppant free fluid external to the common manifold 11. In particular, the hydraulic fracturing system 10 includes a second flow control valve 150 configured to receive the low pressure proppant free fluid from the LP out manifold 106. The second flow control valve 150 is configured to route a small amount of the flow to auxiliary charge pump 114, where it will be mixed with the proppant free fluid from the proppant free fluid tank 116 and routed to the high pressure pumps 118. Providing the second flow control valve 150 may also enable the hydraulic fracturing system 10 to compensate for leakage flow and variable proppant and chemical volumes added at the blender 120. However, in some embodiments, the flow split of the low pressure proppant free fluid and the second flow control valve 150 may be part of the common manifold 11. Further, in certain embodiments, the second control valve 150 and the one or more auxiliary flow control valves 126 may be part of (e.g., integrated with) the common manifold 11. For example, the second control valve 150 and/or the one more more flow control valves 126 may be disposed in and/or integrated with piping of the LP out manifold 106.

Figure 10:
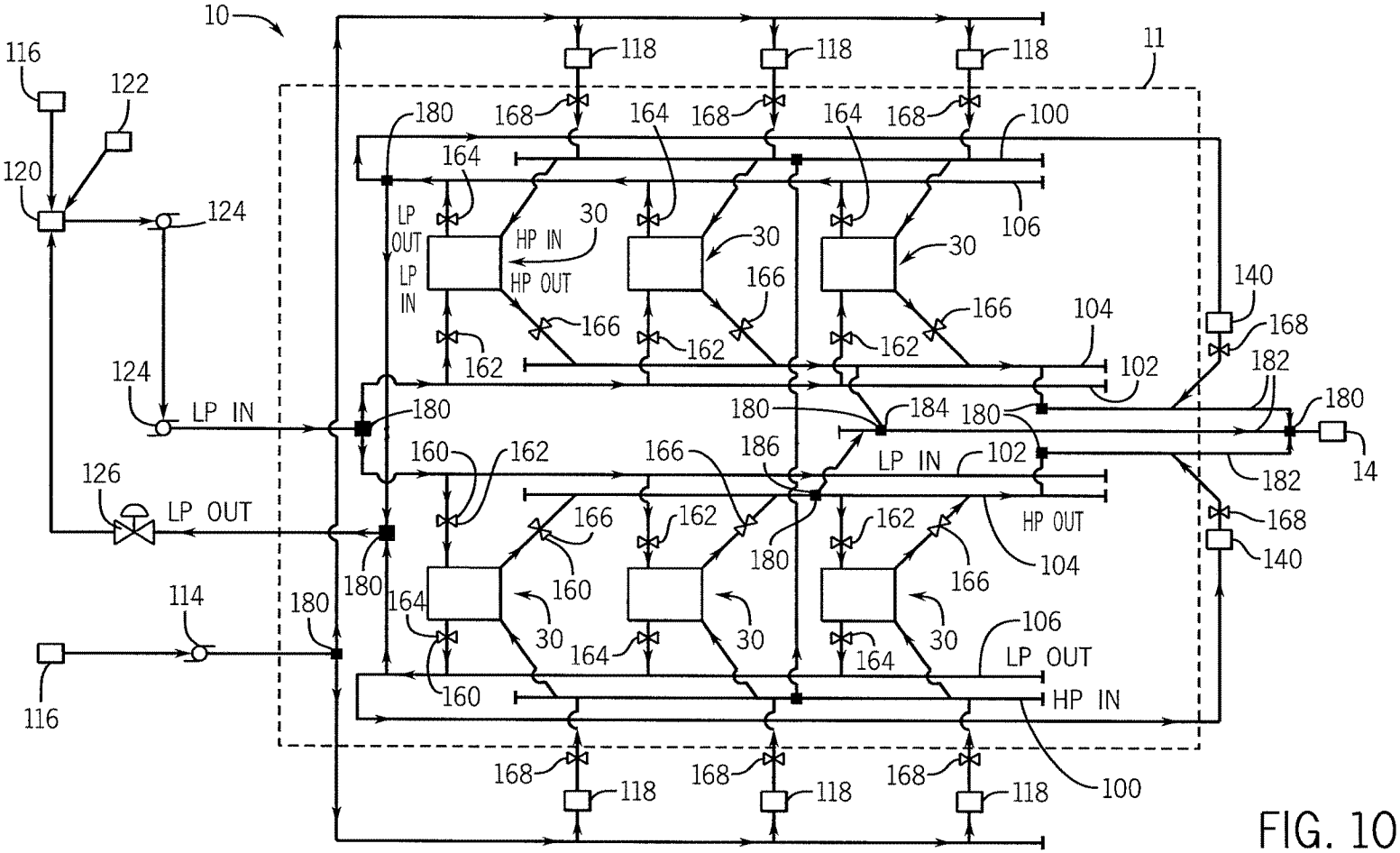
FIG. 10 is a schematic diagram of a flow simulation of the hydraulic fracturing system of FIG. 7.

FIG. 10 illustrates an embodiment of a flow network simulation of the hydraulic fracturing system 10. As illustrated, the hydraulic fracturing system 10 includes six rotary IPXs 30. However, as noted above, any suitable number of rotary IPXs may be used. Additionally, as noted above, the common manifold 11 (e.g., piping of the common manifold 11) may include any suitable number of flow control valves 160 (e.g., high pressure valves, actuated valves), which may be controlled by the processor 110 to control the operation of the rotary IPXs 30. In particular, as noted above, the processor 110 may be configured to selectively adjust, open, and/or close the flow control valves 160 to balance the flow rates among the rotary IPXs 30 and to bring individual rotary IPXs 30 on or offline. For example, the processor 110 may control the flow control valves 160 for a rotary IPX 30 to enable the flow of high pressure first fluid and low pressure second fluid to the rotary IPX 30 to bring the rotary IPX 30 online. To bring the rotary IPX 30 offline, the processor 110 may control the flow control valves 160 for the rotary IPX 30 to halt, stop, or prevent the flow of the high pressure first fluid and the low pressure second fluid to the rotary IPX 30. It should be appreciated that the hydraulic fracturing system 10 may also include a plurality of sensors (e.g., flow meters, pressure sensors, pressure exchanger rotor speed sensors) configured to generate feedback relating to one or more operational parameters of the hydraulic fracturing system 10, such as the flow rates and/or pressures of the fluids (e.g., the high pressure first fluid, the low pressure first fluid, the low pressure second fluid, and/or the high pressure second fluid), the rotational speeds of the rotary IPXs 30, leakage flow from the rotary IPXs 30, the flow and/or volumes of proppant and chemicals into the blender 120, and so forth. The processor 110 may analyze information (e.g., feedback) received from the sensors to control the flow control valves 160. For example, the processor 110 may determine how many rotary IPXs 30 to utilize (e.g., bring or keep online) for a hydraulic fracturing process based at least in part on feedback from sensors relating to the flow (e.g., flow rate, mass flow, etc.) of the incoming first fluid (e.g., from the water tank 116, the pump 114, and/or the high pressure pumps 118) and/or the flow of the incoming second fluid (e.g., from the blender 120, the pump 124, etc.). Further, in some embodiments, the control system 108 may receive input from a user relating to operational parameters of the hydraulic fracturing system 10, and the processor 110 may be configured to control the flow control valves 126 based on the input or an analysis of the input.

In the illustrated embodiment, each rotary IPX 30 includes three flow control valves 160. For example, each rotary IPX 30 includes a first flow control valve 162 disposed proximate to the low pressure inlet, a second control valve 164 disposed proximate to the low pressure outlet, and a third flow control valve 166 disposed proximate to the high pressure outlet. In other embodiments, the rotary IPX 30 may also include a flow control valve disposed proximate to the high pressure inlet. It should be appreciated that the flow control valves 160 may be disposed in and/or integrated with piping of the common manifold 11. For example, each first flow control valve 162 may be disposed in and/or integrated with the LP in manifold 102 (e.g., piping of the LP in manifold 102), each second flow control valve 164 may be disposed in and/or integrated with the LP out manifold 106 (e.g., piping of the LP out manifold 106), and each third flow control valve 166 may be disposed in and/or integrated with the HP out manifold 104 (e.g., piping of the HP out manifold 104). Additionally, the hydraulic fracturing system 10 (e.g., the common manifold 11, the HP in manifold 100, etc.) may include a plurality of flow control valves 168 disposed downstream of the high pressure pumps 118, which may also be controlled by the processor 110 based at least in part upon information received from sensors of the hydraulic fracturing system 10. For example, the processor 110 may control the plurality of flow control valves 168 to control flow of the high pressure first fluid to the rotary IPXs 30. In some embodiments, the processor 110 may independently control each flow control valve 168 to independently control the flow of the high pressure first fluid to each rotary IPX 30 to bring individual rotary IPXs online or offline.

As illustrated, the common manifold 11 may also include a plurality of fluid connections 180 (e.g., pipe laterals, tees, crosses, etc.) to connect various pipes of the common manifold 11. For example, certain fluid connections 180 may connect pipes of the HP out manifold 104 to high pressure wellhead pipes 182 that route the high pressure proppant containing fluid to the well 14. The location, type, and/or angle of the fluid connections 180 that connect the HP out manifold 104 to the high pressure wellhead pipes 182 may be selected to reduce fluid friction losses, to optimally distribute flow within the manifold system, or to prevent proppant from settling out of the fluid (i.e., that the proppant remains entrained in the fluid). For example, a first fluid connection 184 and a second fluid connection 186 may be configured with an angle that is not 90 degrees. In some embodiments, the angle may be between approximately 1 degree and 89 degrees, 10 degrees and 80 degrees, 20 degrees and 70 degrees, 30 degrees and 60 degrees, or 40 degrees and 50 degrees. In one embodiment, the angle may be approximately 45 degrees.

As described in detail above, the common manifold 11 may integrate the one or more rotary IPXs 30 within the low pressure piping and the high pressure piping of the common manifold 11. As such, the one or more rotary IPXs 30 may not be directly coupled to any low pressure or high pressure pumps. This may enable the common manifold 11 to distribute flow among the one or more rotary IPXs 30 despite pipe size and weight constraints. Additionally, this may enable the common manifold 11 to minimize pressure losses, balance flow rates, and compensate for leakage flow among the one or more one or more rotary IPXs 30, as well as to adjust for variable volumes of proppant and chemicals. Further, this may enable the common manifold 11 to bring individual one or more rotary IPXs 30 on or offline without interrupting the fracturing process, and/or to switch the hydraulic fracturing system to traditional operation (e.g., without utilizing the one or more rotary IPXs 30).

It should be noted that various components of the system 10 may be connected via wired or wireless connections. For example, the control system 108 may be connected to the flow control valves 126, 150, 160, 162, 164, 166, and 168 and/or the sensors 142 via wired and/or wireless connections. Further, the control system 108 may include one or more processors 110, which may include microprocessors, microcontrollers, integrated circuits, application specific integrated circuits, and so forth. Additionally, the control system 108 may include the one or more memory devices 112, which may be provided in the form of tangible and non-transitory machine-readable medium or media (such as a hard disk drive, etc.) having instructions recorded thereon for execution by a processor (e.g., the processor 110) or a computer. The set of instructions may include various commands that instruct the processor 110 to perform specific operations such as the methods and processes of the various embodiments described herein. The set of instructions may be in the form of a software program or application. The memory devices 112 may include volatile and non-volatile media, removable and non-removable media implemented in any method or technology for storage of information such as computer-readable instructions, data structures, program modules or other data. The computer storage media may include, but are not limited to, RAM, ROM, EPROM, EEPROM, flash memory or other solid state memory technology, CD-ROM, DVD, or other optical storage, magnetic cassettes, magnetic tape, magnetic disk storage or other magnetic storage devices, or any other suitable storage medium. Further, the control system 108 may include or may be connected to a device (e.g., an input and/or output device) such as a computer, laptop computer, monitor, cellular or smart phone, tablet, other handheld device, or the like that may be configured to receive data and show the data on a display of the device.

While the invention may be susceptible to various modifications and alternative forms, specific embodiments have been shown by way of example in the drawings and have been described in detail herein. However, it should be understood that the invention is not intended to be limited to the particular forms disclosed. Rather, the invention is to cover all modifications, equivalents, and alternatives falling within the spirit and scope of the invention as defined by the following appended claims.

The invention claimed is:

1. A system, comprising:

a hydraulic fracturing system, comprising:

a plurality of rotary isobaric pressure exchangers (IPXs), wherein each rotary isobaric pressure exchanger (IPX) of the plurality of rotary IPXs is configured to exchange pressures between a first fluid and a second fluid, wherein the first fluid comprises a proppant-free fluid, and the second fluid comprises a proppant-laden fluid; and a manifold trailer coupled to the plurality of rotary IPXs, wherein the manifold trailer comprises:

a high pressure inlet manifold coupled to the plurality of rotary IPXs, wherein the high pressure inlet manifold is configured to route the first fluid at high pressure to the plurality of rotary IPXs;

a low pressure outlet manifold coupled to the plurality of rotary IPXs, wherein the low pressure outlet manifold is configured to receive the first fluid at low pressure from the plurality of rotary IPXs;

a low pressure inlet manifold coupled to the plurality of rotary IPXs, wherein the low pressure inlet manifold is configured to route the second fluid at low pressure to the plurality of rotary IPXs; and a high pressure outlet manifold coupled to the plurality of rotary IPXs, wherein the high pressure outlet manifold is configured to receive the second fluid at high pressure from the plurality of rotary IPXs.

2. The system of claim 1, wherein the hydraulic fracturing system comprises one or more high pressure pumps configured to receive the first fluid at low pressure, to pressurize the first fluid, and to provide the first fluid at high pressure to the high pressure inlet manifold.

3. The system of claim 1, wherein the hydraulic fracturing system comprises one or more low pressure pumps configured to provide the second fluid at low pressure to the low pressure inlet manifold.

4. The system of claim 1, wherein the high pressure outlet manifold is configured to route the second fluid at high pressure to a wellhead.

5. The system of claim 1, wherein the low pressure outlet manifold is configured route the first fluid at low pressure to a blender configured to blend the first fluid with proppant to produce the second fluid.

6. The system of claim 1, wherein the manifold trailer comprises a plurality of flow control valves.

7. The system of claim 6, comprising a control system comprising a processor configured to control the plurality of flow control valves.

8. The system of claim 7, wherein the processor is configured to control the plurality of flow control valves to balance flow rates between the plurality of rotary IPXs, to independently bring each hydraulic energy transfer system of the plurality of rotary IPXs online or offline, or both.

9. A system, comprising:

a hydraulic fracturing system comprising:

a plurality of rotary isobaric pressure exchangers (IPXs), wherein each rotary isobaric pressure exchanger (IPX) of the plurality of rotary IPXs is configured to exchange pressures between a proppant-free fluid and a proppant-laden fluid;

a manifold trailer coupled to the plurality of rotary IPXs, wherein the manifold trailer comprises:

a high pressure inlet manifold configured to route the proppant-free fluid at high pressure to the plurality of rotary IPXs;

a low pressure outlet manifold configured to receive the proppant-free fluid at low pressure from the plurality of rotary IPXs;

a low pressure inlet manifold configured to route the proppant-laden fluid at low pressure to the plurality of rotary IPXs;

a high pressure outlet manifold configured to receive the proppant-laden fluid at high pressure from the plurality of rotary IPXs; and a plurality of flow control valves disposed in piping of the manifold trailer; and a control system comprising a processor, wherein the processor is configured to control the plurality of flow control valves to control flow of the proppant-free fluid, flow of the proppant-laden fluid, or both.

10. The system of claim 9, wherein the processor is configured to control the plurality of flow control valves to independently control incoming flow of the proppant-free fluid at high pressure, outgoing flow of the proppant-free fluid at low pressure, incoming flow of the proppant-laden fluid at low pressure, outgoing flow of the proppant-laden fluid at high pressure, or a combination thereof for each rotary IPX of the plurality of rotary IPXs.

11. The system of claim 10, wherein the processor is configured to control the plurality of flow control valves to selectively bring each rotary IPX of the plurality of rotary IPXs online or offline.

12. The system of claim 10, wherein the processor is configured to control the plurality of flow control valves to balance the incoming flow of the proppant-free fluid at high pressure, the outgoing flow of the proppant-free fluid at low pressure, the incoming flow of the proppant-laden fluid at low pressure, the outgoing flow of the proppant-laden fluid at high pressure, or a combination thereof for two or more rotary IPXs of the plurality of rotary IPXs.

13. The system of claim 9, wherein the plurality of flow control valves comprises a first plurality of flow control valves disposed in piping of the high pressure inlet manifold, each flow control valve of the first plurality of flow control valves is downstream of a high pressure pump configured to pressurize the proppant-free fluid, and the processor is configured to control the first plurality of flow control valves to control flow of the proppant-free fluid at high pressure to the plurality of rotary IPXs.

14. The system of claim 13, wherein the plurality of flow control valves comprises a second plurality of flow control valves disposed in piping of the low pressure inlet manifold, and the processor is configured to control the second plurality of flow control valves to control flow of the proppant-laden fluid at low pressure to the plurality of rotary IPXs.

15. The system of claim 13, wherein the plurality of flow control valves comprises a first flow control valve disposed in piping of the low pressure outlet manifold, the processor is configured to control the first flow control valve to control flow of the proppant-free fluid at low pressure to a blender, and the blender is configured to mix the proppant-free fluid with proppant to produce the proppant-laden fluid.

16. A system, comprising:

a hydraulic fracturing system comprising:

a plurality of rotary isobaric pressure exchangers (IPXs), wherein each rotary isobaric pressure exchanger (IPX) of the plurality of rotary IPXs is configured to exchange pressures between a proppant-free fluid and a proppant-laden fluid;

a manifold trailer coupled to the plurality of rotary IPXs, wherein the manifold trailer comprises:

a high pressure inlet manifold configured to route an incoming high pressure flow of the proppant-free fluid to each rotary IPX of the plurality of rotary IPXs;

a low pressure outlet manifold configured to receive an outgoing low pressure flow of the proppant-free fluid from each rotary IPX of the plurality of rotary IPXs;

a low pressure inlet manifold configured to route an incoming low pressure flow of the proppant-laden fluid to each rotary IPX of the plurality of rotary IPXs;

a high pressure outlet manifold configured to receive an outgoing high pressure flow of the proppant-laden fluid from each rotary IPX of the plurality of rotary IPXs;

a plurality of sensors configured to generate feedback relating to the incoming high pressure flow of the proppant-free fluid, the outgoing low pressure flow of the proppant-free fluid, the incoming low pressure flow of the proppant-laden fluid, the outgoing high pressure flow of the proppant-laden fluid, or a combination thereof for each rotary IPX of the plurality of rotary IPXs; and a plurality of flow control valves disposed in piping of the manifold trailer; and a control system comprising a processor, wherein the processor is configured to control the plurality of flow control valves to control the incoming high pressure flow of the proppant-free fluid, the outgoing low pressure flow of the proppant-free fluid, the incoming low pressure flow of the proppant-laden fluid, the outgoing high pressure flow of the proppant-laden fluid, or a combination thereof for one or more rotary IPXs of the plurality of rotary IPXs based on feedback from the plurality of sensors.

17. The system of claim 16, wherein the processor is configured to control the plurality of flow control valves to balance flow rates of the incoming high pressure flow of the proppant-free fluid, the outgoing low pressure flow of the proppant-free fluid, the incoming low pressure flow of the proppant-laden fluid, the outgoing high pressure flow of the proppant-laden fluid, or a combination thereof for two or more rotary IPXs of the plurality of rotary IPXs.

18. The system of claim 16, wherein the processor is configured to control the plurality of flow control valves to selectively bring each rotary IPX of the plurality of rotary IPXs online or offline.

19. The system of claim 16, wherein the processor is configured to control the plurality of flow control valves to compensate for leakage flow from one or more rotary IPXs of the plurality of rotary IPXs.

* * * * *